US005350045A

United States Patent [19]

Robertson

[11] Patent Number: 5,350,045

[45] Date of Patent: Sep. 27, 1994

[54] COMPARTMENTED STORAGE CONTAINER

[76] Inventor: Jeffrey Todd Robertson, 116 Quail La., Whitehouse, Tex. 75791

[21] Appl. No.: 942,649

[22] Filed: Sep. 9, 1992

[51] Int. Cl.[5] ..... A45C 5/12; A45C 13/02; B65D 30/00

[52] U.S. Cl. ..... 190/110; 150/111; 150/113; 383/37; 383/38

[58] Field of Search ..... 206/450; 150/135, 145, 150/148, 111-113, 138; 24/460, 545, DIG. 9, DIG. 20, 560; 190/110, 108; 40/405, 535; 383/37, 38

[56] References Cited

U.S. PATENT DOCUMENTS

| | | | |
|---|---|---|---|
| 406,471 | 7/1889 | Reitz | 40/535 |
| 476,363 | 6/1892 | Burt | 24/560 |
| 2,477,840 | 8/1949 | Vasilas | 150/145 X |
| 2,540,422 | 2/1971 | Broughton | 150/148 X |
| 2,543,437 | 2/1951 | Claxton | 40/535 |
| 2,581,099 | 1/1952 | Guffey | 150/113 X |
| 2,642,913 | 6/1953 | Reis | 150/148 |
| 2,719,557 | 10/1955 | Bell | 150/145 |
| 2,803,281 | 8/1957 | Sutton | 150/145 |
| 3,469,333 | 9/1969 | Roberts | 40/535 |
| 3,507,385 | 4/1970 | George | 24/545 X |
| 3,980,116 | 9/1976 | Edwards | 150/113 |
| 4,444,418 | 4/1984 | Goldstein | 190/901 X |
| 4,708,243 | 11/1987 | Nailon | 150/113 X |

FOREIGN PATENT DOCUMENTS

| | | | |
|---|---|---|---|
| 800639 | 7/1936 | France | 24/545 |
| 26786 | of 1914 | United Kingdom | 24/560 |

*Primary Examiner*—Sue A. Weaver
*Attorney, Agent, or Firm*—Ronald B. Sefrna

[57] ABSTRACT

A comparnnented storage container for storing and transporting a variety of items, including a closable outer container, a multiplicity of item holders, a plurality of holder carriers, and a carrier receiver assembly. A single item holder or a group of item holders is removably connected to each holder carrier, and a plurality of holder carriers is removably connected to the carrier receiver assembly within the outer container, providing compartmented storage space for a multiplicity of items. Each item holder is constructed in a resealable envelope-like configuration of a transparent material, allowing visual inspection, selection, and removal of an individual item without removing holder carriers or item holders from the outer container. Item holders may be readily removed from and replaced in the outer container in groups or individually.

11 Claims, 5 Drawing Sheets

COMPARTMENTED STORAGE CONTAINER

FIELD OF THE INVENTION

The present invention generally relates to apparatus for the storage and transportation of articles, and in some of its embodiments more specifically relates to storage and transporting apparatus with a plurality of removable and interchangeable individual storage compartments.

BACKGROUND OF THE INVENTION

Cases and containers for storing and transporting items are available in a wide variety of types and styles, and many cases and containers have been provided for storing and transporting items of a particular type and character. For example, tackle boxes have been known and used to store and transport fishing gear such as artificial lures, hooks, sinkers, and the like. Cases and containers may be non-specific in design, with the intention that they be usable with a variety of items of various sizes and shapes, or may be very specific in design to accommodate only items of particular configurations. In another design approach, as is typically used with fishing tackle boxes, the interior of the container or case is divided into non-specific compartments, so that items may be divided into the various compartments to achieve at least some internal organization. In all of these approaches, however, when the contents of the container are to be changed it is still necessary to handle individual items to move them from or to the container. Further, these types of container design approaches address storage of items only when they are placed within the container itself, and do not provide an easy means of transfer between container and fixed storage location.

Attempts have been made to address the noted disadvantages and problems, and several approaches are known in the prior art. For example, U.S. Pat. No. 2,888,055 to Dingman discloses a display book or packet for a wallet or similar article, which can be used to retain certain flat items in transparent pockets flat can be removably connected in a wallet enclosure. However, the pockets disclosed by Dingman are suitable for holding only flat items with limited dimensional variation, and the system of attachment makes insertion and removal of the pockets rather cumbersome.

Another approach is illustrated by U.S. Pat. No. 4,793,508 to Thompson, which discloses a system of rigid boards, each with attached item holders, removably retained on a base by a series of pegs. While the Thompson approach is useful for readily removing and replacing boards, each board includes a number of item holders, and no provision is made to facilitate removal of only a single item holder without removing the board on which it is mounted. Further, the system of retaining boards on the base does not provide sufficiently secure retention to maintain the connection between boards and base during rough handling of the container.

U.S. Pat. No. 4,852,293 to Levine et at. illustrates a fishing accessory container having a plurality of flexible removable inserts removably retained in a bag enclosure by zippers. Each of the inserts includes a plurality of individual compartments to hold various fishing accessories. As with the approach illustrated by the Thompson patent, individual item containers are not separately removable, but are grouped on the various inserts. It is therefore not possible to remove and replace a single item container.

There remains a need for a storage container with a multiplicity of item holders that may be individually removed from or connected to the container. There further remains a need for a storage container with a multiplicity of item holders that are easily and individually accessible without the need to remove the holder from the container.

SUMMARY OF THE INVENTION

The present invention provides a compartmented storage container with a multiplicity of item holders or containers that are easily and quickly removable from the container but are firmly retained when connected to the container. The item holders of the invention are disposed within the container structure so as to maximize the utilization of the interior volume of the container while allowing easy and quick access to each holder and the items stored therein.

The compartmented storage container of the invention includes an outer container, a multiplicity of discrete item holders, and a plurality of holder retaining assemblies connected within the container to receive and releasably retain the item holders. Although a wide variety of container types and configurations may be employed within the scope of the invention, a typical container may be configured as a generally conventional tote bag, with a substantially rigid rectangular base, a pair of mating shells, closure means for releasably connecting the shells at their mating edges, and a carrying handle or handles. Each item holder comprises a preferably transparent hollow bag of generally rectangular configuration, open at one end, and sealing means to releasably close the open end to retain items in the interior of the holder. It is preferred that the item holders be of simple construction and of inexpensive materials, so that the cost of each item holder is minimal.

Each holder retaining assembly component of the invention generally comprises a holder carrier to be attached to an item holder at the end of the holder opposite the open end, and a carrier receiver connected to the base of the container, to receive and releasably retain a holder carrier and associated item holder within the container. In the preferred embodiment, each holder carrier comprises an elongate hollow tube open on at least one end, and having a longitudinal slit extending from an open end of the tube to the opposite end parallel to the longitudinal axis of the carrier tube. The holder carriers are preferably formed of a shape retentive material so that each carrier will resist deformation and resist widening of the slit formed therein. Attachment between an item holder and a holder carrier is made by placing an elongate retaining rod in the interior of the item holder at the end of the holder opposite the open end and inserting the item holder into the slit of the holder carrier so that the retaining rod and a portion of the item holder are disposed within the interior of the holder carrier, the item holder extends through the slit in the carrier, and the majority of the item holder extends outwardly from the slit in the holder carrier. The holder carrier may be attached to a single item holder, or to several grouped item holders, each with a retaining rod, as desired.

In the preferred embodiment each carrier receiver comprises a pair of separate loops interconnected to the base of the outer container with the axes of the loops in coaxial alignment, and with the common axis of the loops parallel to the longitudinal axis of the rectangular base. The length of the base is greater than the length of the holder carrier components, and the distance of separation between the two loops of each carrier receiver is less than the length of the holder carriers. The cross-sectional dimension of each loop is slightly greater than the cross-sectional dimension of the holder carriers, and each holder carrier is releasably connected to the respective carrier receiver by inserting one end of the holder carrier through one of such loops from the interior side of the loop, then inserting the opposite end of the holder carder through the other loop, and sliding the holder carrier relative to the loops as needed to generally center the holder carrier on the base of the outer container. Each holder carrier, and the associated item holders, is easily removed from the outer container by reversing the connection steps.

With the compartmented storage container of the invention, a user may fill each of a multiplicity of item holders with, for example, plastic fishing worms of various colors, shapes, etc., may group several item holders together for retention by a holder carrier or use a single holder carrier for a single item holder, as desired; and removably connect a plurality of holder carriers and item holders in the outer container for storage or use. When the user desires to retrieve an item from the container, the user may open the outer container, select the appropriate item holder, open that item holder and remove the desired item without removing the holder carrier and item holder from the outer container. Alternatively, the user may easily remove the appropriate holder carrier and retained item holders from the outer container before retrieving an item.

With each item holder being available at minimal cost, a user may use extra item holders and holder carriers to store additional items outside the container, so that when the user desires to change the selection of items, such as plastic fishing worms, in the container, the change can be easily and quickly accomplished by removing one or more holder carriers and item holders from the outer container and replacing them with a new selection from storage. A user may also change the selection of items grouped with each holder carrier by removing some or all of the item holders associated with a particular holder carrier and replacing them with a new selection of items stored in additional item holders. The storage container of the invention thus allows a user to readily change the selection of items in two different ways without the need to transfer items from one item holder to another; by replacing a group of item holders and associated holder carrier with another group of item holders and associated holder carrier, or by replacing individual item holders in a group retained by a single holder carrier.

The structure and features of the preferred embodiment and of various alternative embodiments of the compartmented storage container of the invention will now be described in more detail with reference to the accompanying drawing figures.

DESCRIPTION OF THE INVENTION

Figure 1:
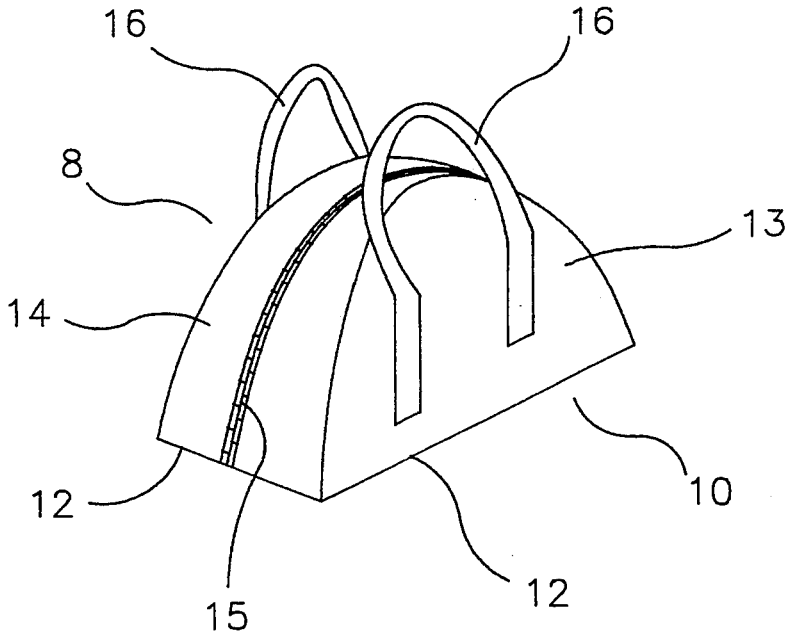
FIG. 1 is a perspective view of the preferred embodiment of the storage container of the invention with the outer container in a closed configuration.
Figure 2:
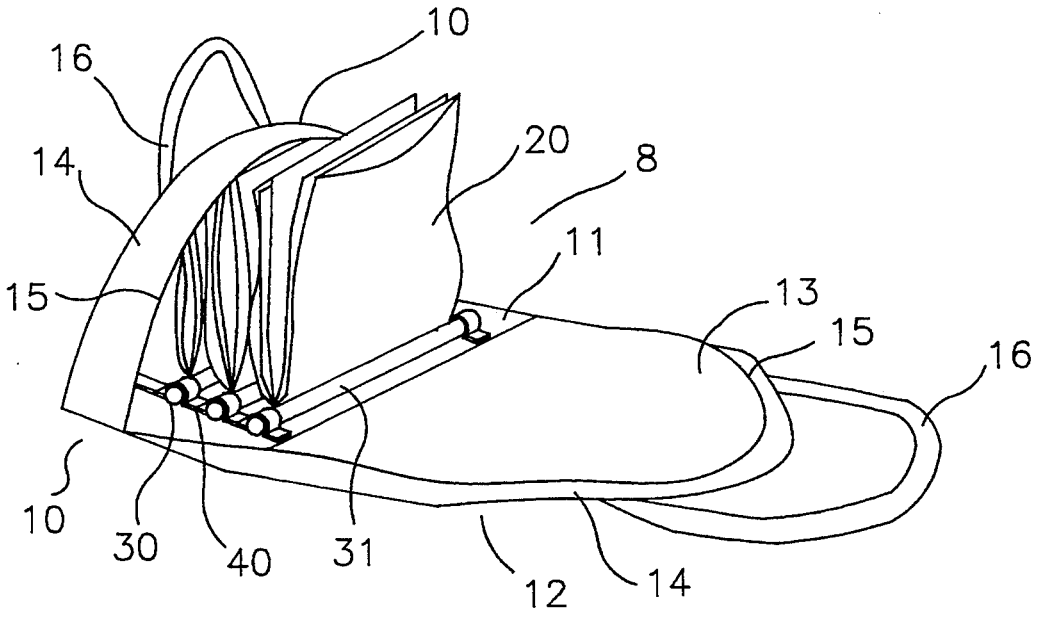
FIG. 2 is a perspective view of the preferred embodiment of the storage container of the invention with the outer container opened.
Figure 3:
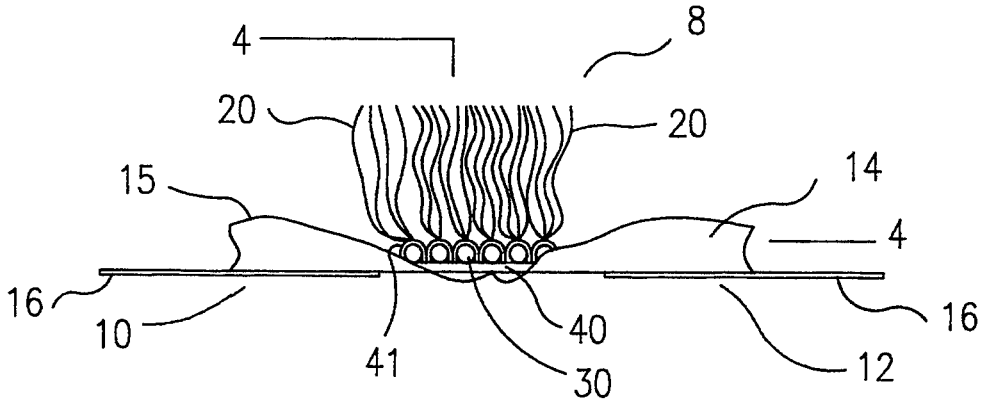
FIG. 3 is a partial end view of the preferred embodiment of the storage container of the invention with the outer container open and both Sides folded away.

With reference to the accompanying drawing figures, in which FIGS. 1 through 5 depict the preferred embodiment, the compartmented storage container of the invention, generally designated by reference numeral 8, generally comprises an outer container 10, a multiplicity of item holders 20, and holder retaining assemblies 30. Outer container 10 includes a substantially rigid base 11 and a pair of mating shells 12 interconnected to and extending upwardly from base 11, defining a hollow interior of outer container 10. Each of shells 12 includes a side element 13 and a continuous edge element 14, extending from the edges of side element 13 in generally perpendicular relation thereto. Outer container 10 further includes closure means 15, preferably a zipper extending along the mating edges of edge elements 14, and handles 16. In the preferred embodiment, outer container 10 is a generally conventional soft sided tote bag type container constructed of a durable fabric material, but any type of container that provides a suitable interior volume and suitable access may be utilized within the scope of the invention.

Figure 5:
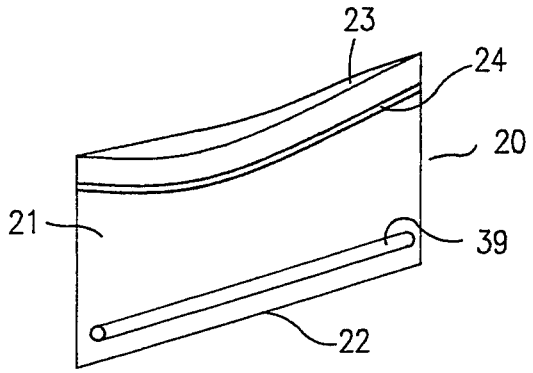
FIG. 5 is a perspective view of the preferred embodiment of the item holder component of file invention with a retaining rod therein.

In the preferred embodiment, each of item holders 20, as illustrated in FIG. 5, comprises a hollow envelope-like enclosure with a continuous side wall 21, a closed bottom edge 22, an open top edge 23, and sealing means 24 for releasably sealing top edge 23 to close the interior of item holder 20. It is preferred that sealing means 24 be an interlocking type seal construction such as that identified by the trademark "Ziplock," although other seal designs may be utilized if desired. It is preferred, but not essential, that sealing means 24 create an air tight seal. It is also preferred that item holders 20 be constructed of a transparent plastic material to facilitate identification of items contained in an item holder without the need for opening the holder or separately labeling each holder. Conventional food storage bags, such as those marketed under the trademark "Ziplock" as but one example, are very suitable for use as item holders 20, with the advantages of ready availability and low cost.

Holder retaining assemblies 30, depicted in the preferred embodiment in FIGS. 2 through 6, comprise a plurality of holder carriers 31, retaining rods 38, and carrier receivers 40. Each holder carrier 31 includes an elongate hollow tube 32 with a first end 33 and a second end 34. First end 33 is open, and second end 34 may be open or closed, though second end 34 is open in the preferred embodiment for ease and economy of construction. Tube 32 is provided with elongate slot 35 formed in the wall of tube 32 and extending from first end 33 perpendicular to the longitudinal axis of tube 32 through the full length of tube 32, though slot 35 may be terminated short of second end 34 if desired. Holder carrier 31 further includes a pair of spacer inserts 36, one to be received in each of the respective ends of tube 32, and a pair of end caps 37, one to be received over each of the respective ends of tube 32. Each end cap 37 preferably includes shoulder 38 extending around the open end of the cap.

Figure 7:
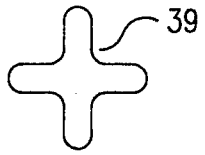
FIG. 7 is an end view of an alternative embodiment of the item holder retaining rod component of the invention.
Figure 6:
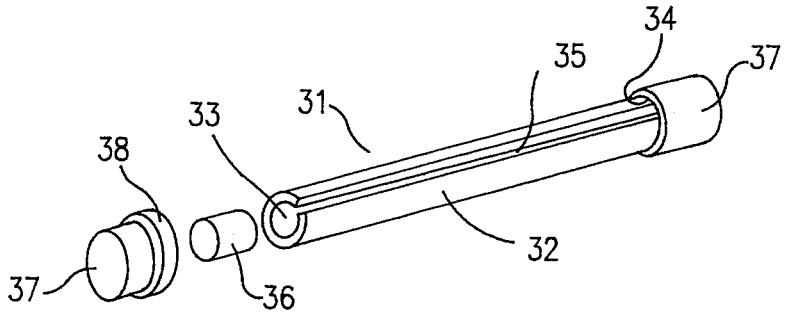
FIG. 6 is a perspective view of the preferred embodiment of the holder carrier components of the invention.

Item holders 20 are connected to holder carriers 31 by placing a retaining rod 39 in each item holder adjacent to closed edge 22, as shown in FIG. 5, and the item holders to be connected to a holder carrier 31 are slid into slot 35 with closed edge 22 and retaining rod 39 of each item holder in the interior of tube 32 and the remainder of each item holder extending outwardly from slot 35. A spacer 36 is placed in each end of tube 32 (or in first end 33 if second end 34 is closed) and an end cap 37 is placed over each end of tube 32. Retaining rods 39 serve to prevent closed ends 22 of item holders 20 from slipping through slot 35 without the need to form a permanent connection between item holders 20 and holder carrier 31. Retaining rods 39 may be circular in cross-sectional configuration as shown in FIG. 5, or may be provided with surface irregularities such as lobes, shown in FIG. 7. The length of tube 32 is sufficiently greater than the length of closed end 22 of each item holder 20 to accommodate spacers 36 and end caps 37, so that item holders 20 extend from slot 35 between spacers 36 and end caps 37.

Figure 4:
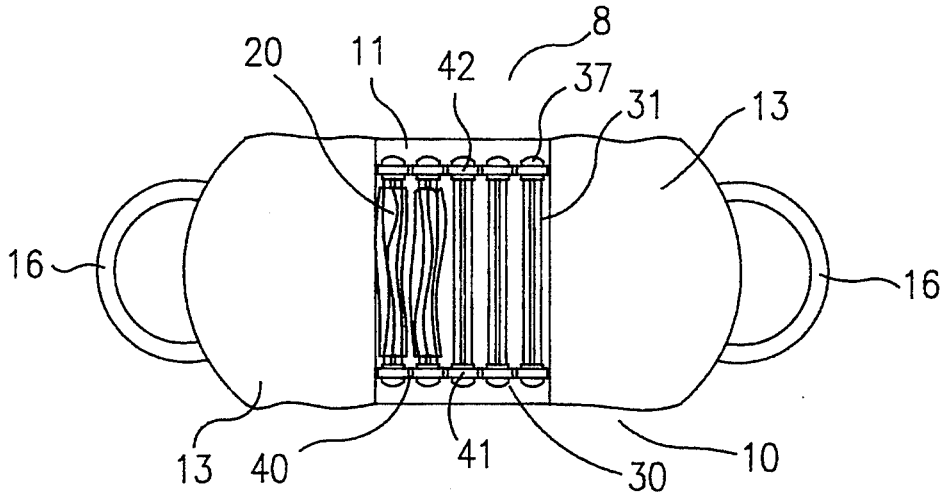
FIG. 4 is a partially sectioned top view of the opened outer container of the preferred embodiment of the storage container of the invention along line 4—4 of FIG. 3, showing the preferred embodiment of the carrier receiver.

Carrier receiver 40 comprises a first receiver 41 and a second receiver 42, disposed in parallel relation at opposite ends of base 11 of outer container 10, as depicted in FIG. 4. In the preferred embodiment, first receiver 41 and second receiver 42 each comprise an elongate strip of fabric or other flexible material interconnected to base 11 to form a plurality of loops, each loop being slightly, larger in cross-sectional dimension than the cross-sectional dimension of end caps 37. Each loop of first receiver 41 is coaxially aligned with a loop of second receiver 42. Each holder carrier 31 with item holders 20 is removably connected to carrier receiver 40 by inserting one end of the holder carrier into a loop of, e.g., second receiver 42 until shoulder 38 of the associated end cap 37 contacts the edge of the loop, then inserting the opposite end of holder carrier 31 into the aligned loop of, e.g., first receiver 41, slightly deforming either or both tube 32 and the loop of first receiver 41 if necessary to accomplish the insertion. After connection, a loop of second receiver 42 surrounds end cap 37 at second end 34 of tube 32, and the aligned loop of first receiver 41 surrounds end cap 37 at first end 33, removably retaining the holder carrier and connected item holders in the interior of outer container 10.

A user of the storage container of the invention is afforded the ability to exchange item holders retained in the outer container in two different ways. Item holders connected to a particular holder carrier may be exchanged as a group by exchanging one filled holder carrier for another, and individual item holders may be exchanged by removing one item holder from the associated holder carrier and replacing it with another.

When a user of the storage container of the invention wishes to remove an item from an item holder the user opens the outer container, visually inspects the interior of the item holders arrayed in the interior of container 10 and selects the desired item, opens the appropriate item holder, removes the desired item, closes the item holder, and closes the outer container. With outer container fully opened and the two shells 12 separated, as in FIG. 3, item holders 20 may be "fanned" and easily inspected. Base 11 of outer container 10 may be provided as a discrete component so that base 11, with connected components, may be removed from outer container 10 and placed in a convenient location for repeated access, during fishing for example, without the inconvenience of dealing with outer container 10 each time, and then replaced in outer container 10 for transportation and storage.

Figure 8:
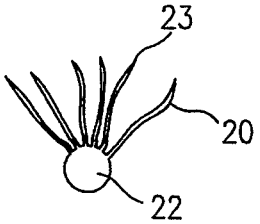
FIG. 8 is an end view of an alternative embodiment for item holder components of the invention.
Figure 11:
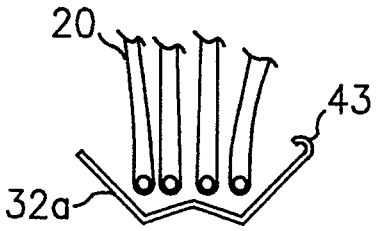
FIG. 11 is an end view of a first alternative embodiment of the holder carrier component of the invention.
Figure 13:
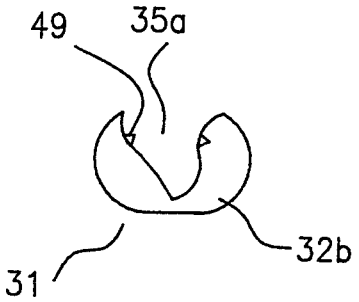
FIG. 13 is an end view of a second alternative embodiment of the holder carrier component of the invention.

In addition to the variation and modifications discussed above, the invention may be provided in a number of alternative embodiments within the basic scope of the invention, and several non-limiting examples of alternative embodiments will be disclosed. FIG. 8 illustrates an alternative form for item holders 20, in which several item holders are permanently grouped and interconnected at their closed ends 22 to form a thickened mutual closed end 22. The illustrated alternative design allows retainer rods 39 to be eliminated, but sacrifices interchangeability of individual item holders 20. FIG. 11 shows a simplified alternative embodiment of holder carrier 31, in which tube 32 is replaced by a clamping body **32*a* provided with interlocking means 43 to securely grip item holders 20. Utilization of the FIG. 11 alternative allows retaining rods 39 to be eliminated if desired, and also allows spacers 36 and end caps 37 to be omitted from the holder carrier structure, since item holders are firmly retained by clamping body 32*a*. Clamping body 32*a* may be opened for replacement of individual item holders 20. FIG. 13 illustrates a further alternative embodiment of holder carrier 31, in which tube 32 is replaced by a solid body 32*b* that is longitudinally divided, either partially or fully, to provide contoured mating faces that form a slot 35*a* extending through the length of body 32*b*. Gripping nipple, or studs 49, to be received in apertures 50 to penetrate the side walls of and securely retain item holders disposed in slot 35*a* with body 32*b* closed, and the contour formed by the mating faces of body 32*b*** facilitates positive retention of the item holders.

Figure 9:
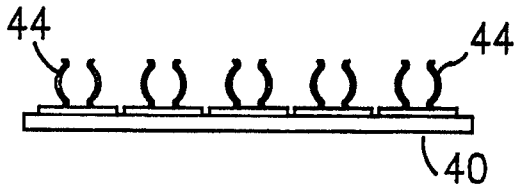
FIG. 9 is an end view of a first alternative embodiment of the carrier receiver component of the invention.
Figure 10:
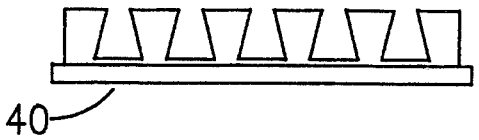
FIG. 10 is an end view of a second alternative embodiment of the carrier receiver component of the invention.
Figure 12:
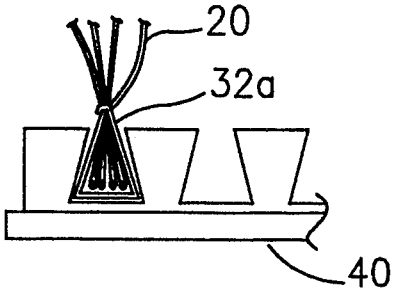
FIG. 12 is an end view of a third alternative embodiment of the carrier receiver component of the invention, with the alternative holder carrier of FIG. 11.

An alternative embodiment of carrier receiver 40, in which the loops of one or both of first receiver 41 and second receiver 42 are replaced by clips 44, as shown in FIG. 9, allowing one or both ends of a holder carrier to be pressed into a clip 44 rather than inserted through a loop. Another alternative embodiment of carrier receiver 40, particularly suited for use with the alternative embodiment of holder carrier 31 of FIG. 11, is shown in FIG. 10. FIG. 12 shows a FIG. 11 alternative holder carrier, with item holders, retained in the FIG. 10 alternative carrier receiver.

Figure 14:
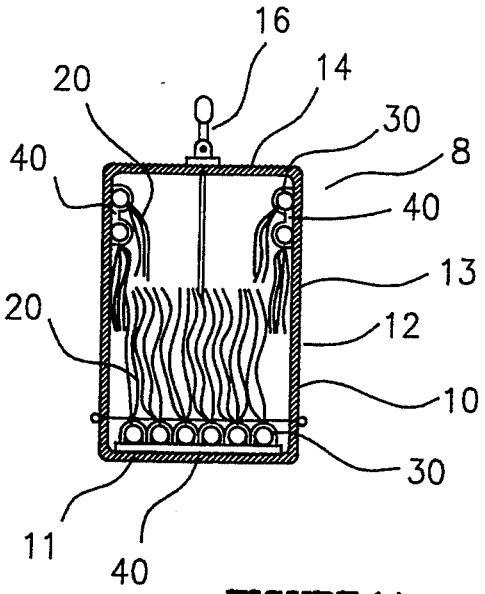
FIG. 14 is a sectioned end view of a first alternative embodiment of the storage container of the invention.

FIG. 14 shows an alternative embodiment of the container of the invention in which outer container 10 is formed as a hard sided case, with shells 12 hinged at or near their intersection with base 11. As shown in FIG. 14, though not limited to the illustrated embodiment of outer container 10, additional carrier receivers 40 may be disposed on the inner surface of sides 13 of outer container 10, to receiver additional holder carriers and associated item holders and increase the capacity of storage container 8.

Figure 15:
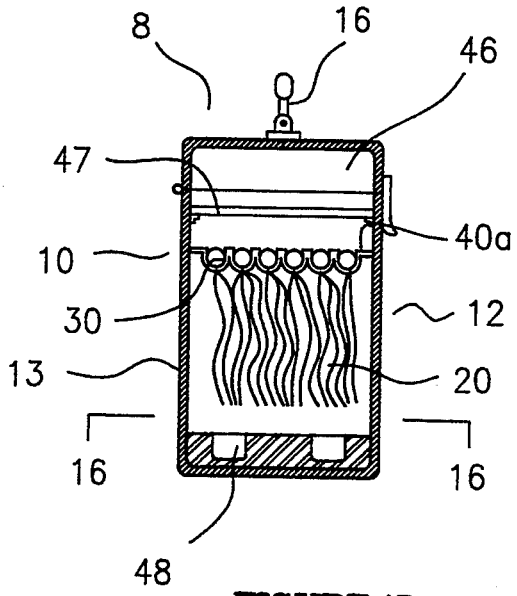
FIG. 15 is an end view of a second alternative embodiment of the storage container of the invention.
Figure 16:
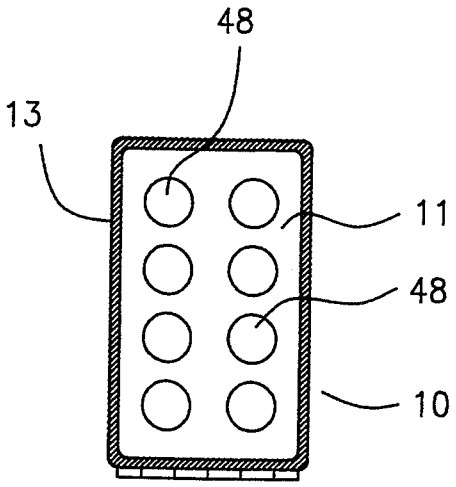
FIG. 16 is a sectioned top view of the second alternative embodiment shown in FIG. 15, along line 16—16 of FIG. 15.

Another variation of the storage container of the invention is illustrated in FIGS. 15 and 16. In this alternative embodiment, outer container 10 is formed as a hard sided case with an open able lid and an openable end. Carrier receiver 40 is formed as a rigid shelf 40*a*, provided with a plurality of slots 45 so that item holders 20 connected to a holder carrier 31 may be slid into one of such slots with holder carrier 31 resting on and supported by carrier receiver 40*a* and item holders 20 having in the open interior of the bottom portion of outer container 10. Carrier receiver 40*a* may be fixed relative to outer container 10, or may be slidably disposed in outer container 10 so that it may be slid outwardly to facilitate inspection of and access to item holders 20. In the alternative embodiment of FIG. 15, outer container 10 is also provided with an upper storage compartment 46 with a floor 47. A further storage area may be provided in association with base 11 of outer container 10, as shown in FIG. 16, in which base 11 is provided with a plurality of receptacles 48 of any convenient configuration.

Although reference has been made to the utility of the container of the invention for organizing fishing accessories, it is to be understood that the preferred and alternative embodiments may be effectively used in a wide variety of application. Non-limiting examples include salesperson's sample cases, sewing accessory cases, craft item storage cases, suitcases for clothing, and medication cases.

A group of item holders 20, secured by a holder carrier 31, may also be used as an independent unit for conveniently storing and transporting a plurality of individual items in an organized arrangement. One or more of such independent units may be beneficially utilized to organize small items used for camping purposes, especially backpacking, and to keep such items together and readily accessible in a backpack. Each such unit may be placed in a backpack without being otherwise enclosed or fastened to the backpack itself, each unit may be enclosed in a separate pouch to be placed in a pack, or one or more carrier receivers may be provided in a backpack compartment to receive and hold one or more such units in a fixed position relative to the pack with the pack functioning as outer container 10.

The foregoing detailed description of the preferred embodiment and certain alternative embodiments of the invention is illustrative and not for purposes of limitation. It will be understood that the compartmented storage container of the invention is susceptible to numerous additional modifications and alternative embodiments without departing from the scope of the invention as claimed.

What is claimed is:

1. A compartmented storage container, useful for organizing and containing a number of items, comprising an outer container having peripheral walls defining a hollow interior with an inner surface, having an access opening from the exterior to the interior of said outer container, and having closure means for selectively closing and opening such access opening;

a plurality of item holders to be received in the interior of said outer container, each of said item holders having a side wall, a closed bottom, and an open top, defining a hollow envelope-like enclosure open at the top, and sealing means to releasably seal said open top;

a holder carrier to releasably connect a group of said item holders, said holder carrier having an elongate body with a longitudinal axis and first and second ends, with a cavity in the interior of said elongate body to receive said closed bottom of each of said item holders of the group of item holders to be connected, and with passage means for extension of said side wall of each of said item holders from the interior of said elongate body to the exterior thereof;

retaining means for retaining said closed bottoms of said item holders in the interior of said elongate body.

2. The compartmented storage container of claim 1, further comprising a carrier receiver, to releasably receive and retain said holder carrier, said carrier receiver including attachment means for releasable attachment of said holder carrier thereto.

3. The compartmented storage container of claim 2, wherein said carrier receiver is interconnected to said inner surface of said outer container.

4. The compartmented storage container of claim 2, wherein said holder carrier is greater in length than the length of said closed bottom of each of said item holders such that each of said first and second ends of said holder carrier extends outwardly beyond the respective edge of said item holders connected thereby, wherein the compartmented storage container includes an even number of carrier receivers not less than two, wherein each of said carrier receivers comprises an elongate body, having a longitudinal axis, interconnected to said inner surface of said outer container so as to form a plurality of loops having parallel central axes, with said central axes perpendicular to the longitudinal axis of said body and with each of said loops dimensioned to receive an end of a holder carrier therethrough, said carrier receivers disposed on said inner surface of said outer container in paired relationship with the longitudinal axes of paired carrier receivers in parallel relation, with the central axes of said loops of said carrier receivers in coaxial relation, and with the carrier receivers of each pair separated from each other a distance approximately equal to the length of said holder carrier, and wherein said attachment means comprises each pair of coaxially aligned loops of each pair of carrier receivers.

5. The compartmented storage container of claim 1, wherein said body of said holder carrier comprises a hollow tube with a first end corresponding to said first end of said body and a second end corresponding to said second end of said body, said tube being open at said first end and having an annular wall, wherein said passage means comprises an elongate aperture extending through said annular wall from the exterior of said tube to the interior thereof and extending parallel to said longitudinal axis of said body from said first end of said tube through a portion of the length of said tube between said first and second ends thereof, and wherein said holder carrier further includes a first cap removably connected to said tube at the first end thereof so as to close said first end.

6. The compartmented storage container of claim 5, wherein said retaining means comprises a plurality of elongate rods, each to be received in the interior of one of said item holders and disposed adjacent to and in alignment with said closed bottom of said item holder, such that each of said rods is disposed in the interior of said tube with the closed bottom of an associated item holder so as to prevent said closed bottom of said item holder from passing through said elongate aperture of said tube.

7. The compartmented storage container of claim 5, wherein said tube of said holder carrier is open at said second end thereof, and wherein said holder carrier further includes a second cap removably connected to said tube at said second end thereof so as to close said second end.

8. The compartmented storage container of claim 7, wherein of said holder carrier further includes a first spacer to be inserted into said first end of said tube and extend between said first end and the adjacent edge of item holders received in said tube, and a second spacer to be inserted into said second end of said tube and extend between said second end and the adjacent edge of item holders received in said tube.

9. The compartmented storage container of claim 1, wherein said outer container comprises a soft sided tote bag having a substantially planar base with a longitudinal axis and first and second ends, wherein said peripheral walls comprise flexible shells interconnected to said base with mating edges extending between said first and second ends of said base and meeting in a plane parallel to the longitudinal axis of said base, wherein said access opening is formed between said mating edges of said shells, and wherein said closure means extends along the full length of said mating edges of said shells.

10. A compartmented storage container comprising a plurality of item holders each having a side wall, a closed bottom, and an open top, defining a hollow envelope-like enclosure open at the top, and sealing means to releasably seal said open top;

a single holder carrier to releasably connect a group of said item holders, said holder carrier having an elongate body with a longitudinal axis and first and second ends, a cavity in the interior of said elongate body to receive said closed bottom of each of said item holders of the group of item holders to be connected, passage means for extension of said side wall of each of said item holders from the interior of said elongate body to the exterior thereof;

retaining means for retaining said closed bottoms of said item holders in the interior of said elongate body; and an outer container having a hollow interior configured and dimensioned to receive said item holders and holder carrier therein, having an access opening for access to the interior of said outer container, and further having sealing means for selectively closing and opening said access opening.

11. A compartmented storage container, comprising an outer container having peripheral walls defining a hollow interior with an inner surface, having an access opening from the exterior to the interior of said outer container, and having closure means for selectively closing and opening such access opening;

a plurality of item holders to be received in the interior of said outer container, each of said item holders having a side wall, a closed bottom, and an open top, defining a hollow envelope-like enclosure open at the top, and sealing means to releasably seal said open top;

a holder carrier to releasably connect a group of said item holders, said holder carrier having an elongate body with a longitudinal axis and first and second ends, a cavity in the interior of said elongate body to receive said closed bottom of each of said item holders of the group of item holders to be connected, passage means for extension of said side wall of each of said item holders from the interior of said elongate body to the exterior thereof;

retaining means for retaining said closed bottoms of said item holders in the interior of said elongate body; and a carrier receiver to releasably receive and retain said holder carrier, said carrier receiver including attachment means for releasable attachment of said holder carrier thereto.

* * * * *